US006112802A

United States Patent [19]

Hudelmaier et al.

[11] Patent Number: 6,112,802

[45] Date of Patent: Sep. 5, 2000

[54] PROCESS FOR PRODUCING AN INTERMETALLIC JOIN

[75] Inventors: Birgit Hudelmaier, Esslingen; Dieter Mueller-Schwelling, Fellbach; Detlef Schlosser, Kirchheim, all of Germany

[73] Assignee: Mahle GmbH, Stuttgart, Germany

[21] Appl. No.: 09/051,050

[22] PCT Filed: Sep. 20, 1996

[86] PCT No.: PCT/DE96/01808

§ 371 Date: Mar. 31, 1998

§ 102(e) Date: Mar. 31, 1998

[87] PCT Pub. No.: WO97/13597

PCT Pub. Date: Apr. 17, 1997

[30] Foreign Application Priority Data

Oct. 11, 1995 [DE] Germany ..... 195 37 847

[51] Int. Cl.[7] ..... B22D 19/00; F02F 3/00

[52] U.S. Cl. ..... 164/100; 92/225; 92/228; 92/229; 123/193.6; 164/75; 164/101; 164/103

[58] Field of Search ..... 164/100, 75, 101, 164/103; 123/193.6; 92/225, 228, 229

[56] References Cited

U.S. PATENT DOCUMENTS

| | | | |
|---|---|---|---|
| 2,550,879 | 5/1951 | Stevens, Jr. . | |
| 2,620,530 | 12/1952 | Sulprizio | 164/75 |
| 2,775,493 | 12/1956 | Cheney | 123/193.6 X |
| 4,829,883 | 5/1989 | Raggi | 123/193.6 X |
| 5,092,289 | 3/1992 | Bloschies et al. | 123/193.6 |
| 5,119,777 | 6/1992 | Mielke et al. | 123/193.6 |

FOREIGN PATENT DOCUMENTS

| | | | |
|---|---|---|---|
| 901104 | 1/1954 | Germany . | |
| 1048677 | 1/1959 | Germany . | |
| 4221448 | 1/1994 | Germany . | |
| 645562 | 10/1984 | Switzerland . | |
| 1507532 | 9/1989 | U.S.S.R. | 164/103 |
| 2137659 | 10/1984 | United Kingdom . | |
| WO93/11896 | 6/1993 | WIPO . | |

OTHER PUBLICATIONS

Fubganger, A. Eisengusswerkstoffe im Fahrzeugbau Gestern, Heute–Morgen? In: Konstruktion 44, 1992, S. 193–204.

Database WPI Section Ch, Week 7635, Derwent Publ Ltd., London, GB; Class M22, AN76–66022X Xp00209506 & JP 51025214B (Tokyo Kogyo Co) Jul. 29, 1976.

*Primary Examiner*—J. Reed Batten, Jr.

*Attorney, Agent, or Firm*—Collard & Roe, P.C.

[57] ABSTRACT

The aim is to improve the strength of an intermetallic bond between engine component made from an aluminium alloy and a reinforcing element made from austenitic cast iron. For that purpose, the reinforcing element is annealed in a decarbonising atmosphere before the known prior art alfin process is carried out, in order to obtain an alfin layer largely free of graphite scales.

3 Claims, 1 Drawing Sheet

PRIOR ART

PROCESS FOR PRODUCING AN INTERMETALLIC JOIN

The invention relates to a process for producing an intermetallic bond between an engine component made from an aluminum-based alloy, and a reinforcing component made from austenitic cast iron, said components being bonded to each other by casting technique. Corresponding processes are employed particularly for producing ring carriers, and in some cases also for producing trough edge reinforcements in connection with Diesel engines.

The bond between the reinforcing component and the material of the piston is produced in this connection by the alfin process, which is known in the state of the art since about 1950, by immersing the reinforcing component in an AlSi-melt before the material of the piston is poured around it, whereby an intermetallic layer is formed on the surface of the reinforcing component.

The ignition pressures in Diesel engines, which continually increased in the past, revealed the strength limits of the alfin-bond produced heretofore, so that a higher bonding strength is now required.

Therefore, it was already proposed in DE-OS 42 21 448 to employ austenitic cast iron with a globular or vermicular graphite configuration as the reinforcing material, which, as compared to the usual cast iron alloy material with a lamellar graphite configuration, improves the bonding strength as a result of the lesser notching effect of the graphite particles bonded in the layer. This solution, however, also has various drawbacks.

First, it means abandonment of a ring carrier material which has been successfully employed since a long time. Furthermore, the grey cast iron alloy material offers superior workability, higher thermal conductivity and higher resistance to wear, and it is slightly less costly than the grey cast iron graphite ring carrier material.

The invention therefore deals with the problem of increasing the strength of the intermetallic bond between the reinforcing component and the material cast around it irrespective of whether a grey cast iron graphite or a grey cast iron alloy material is used.

Said problem is solved by a process with the features of the invention as described herein.

An important field of application for the process as defined by the invention is the manufacture of pistons with reinforcing components made from austenitic cast iron, whereby the reinforcing components are preferably ring carriers.

By annealing the austenitic basic material until the zone participating in the production of the intermetallic bond is largely degraphitized, the notching effect of the graphite lamellae or other graphite particles is prevented in a simple way and at favorable cost, and a nearly flawless intermetallic layer can develop. First tear-off tests show that the tensile strength of the layer as defined by the invention was increased by at least 30% as compared to the tensile strength of conventional alfin-bonds.

Annealing of the reinforcing components has to be carried out in a furnace atmosphere with oxidizing and reducing components in order to largely prevent differences in concentration to occur due to diffusion of the nickel to the surface and formation of iron oxides on the surface, as a surface so formed has an interfering effect in the subsequent process steps.

The invention is explained in the following with the help of an exemplified embodiment.

A reinforcing component made from austenitic cast material 1 with a lamellar graphite configuration is bonded to a piston material AlSi12CuNiMg 2 by an alfin-layer 3. Within the zone of the alfin-bond, the austenitic cast material is degraphitized on the edge up to a depth of about 100 to 150 $\mu$m. Degraphitization is carried out by annealing of the cast material in exo-gas at temperatures of at least 800° C. and preferably at temperatures of >1000° C. The $CO_2$— and CO— contents and the thaw point have to be adjusted in this connection in such a way that a well-decarbonizing effect is obtained in order to obtain short annealing times. In the present case, the annealing time came to 25 minutes.

Differences in concentration and the formation of oxides on the surface are largely avoided by using exo-gas, which has both reducing and oxidizing components.

The other process steps correspond with the alfin-process known in the state of the art.

Only loosened, incoherent, pearl-string-like oxides are visible in alfin-layer 3 instead of compact graphite lamellae. Such oxides have no or at least a substantially lesser effect on the strength of the alfin-layer than the graphite lamellae of an unannealed austenitic cast iron.

Figure 1:
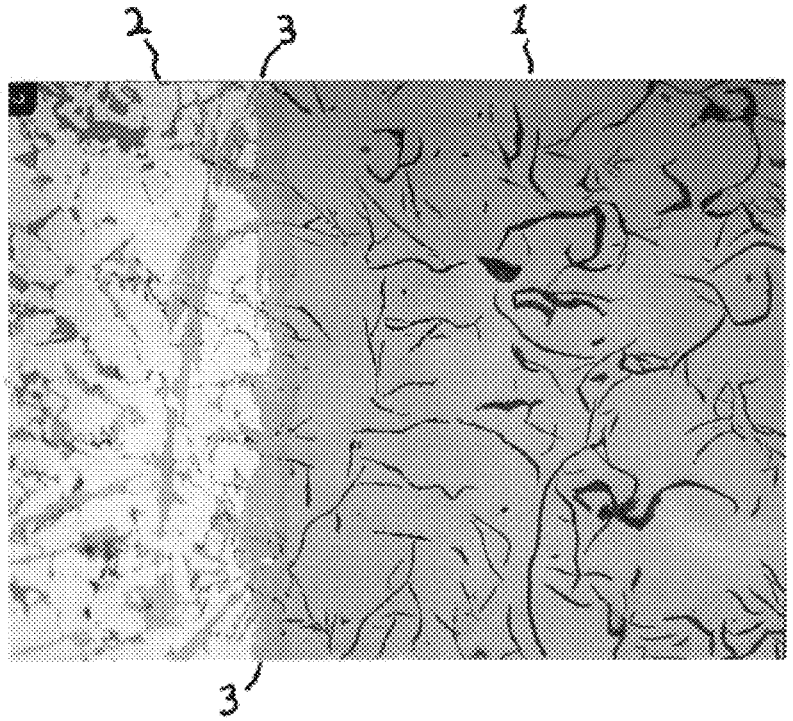
FIG. 1 shows a cross ground section of an alfin-bond as defined by the invention, with a reinforcing component degraphitized on the edge.
Figure 2:
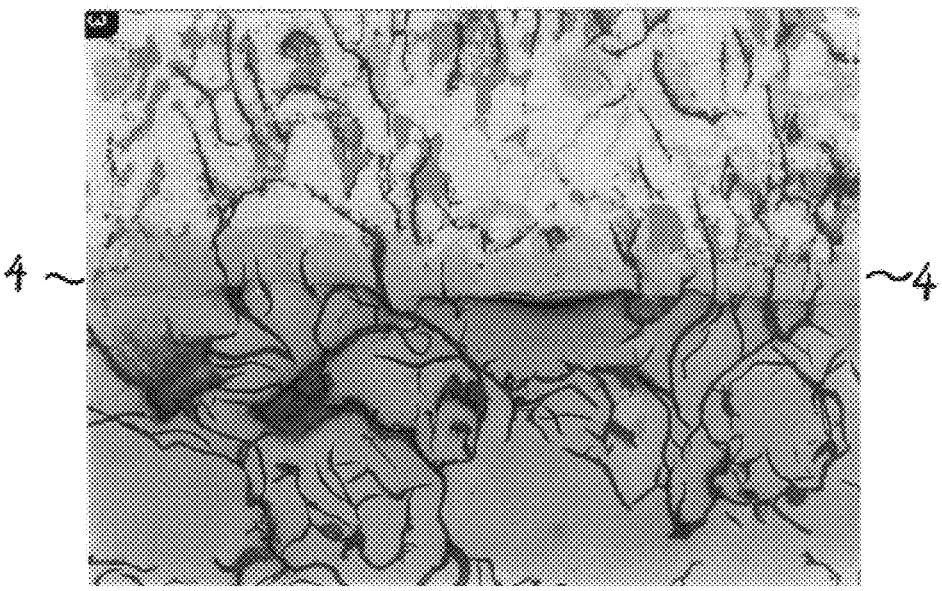
FIG. 2 shows a cross ground section of an alfin-bond without edge degraphitization for comparison purposes.

A conventional alfin-layer is shown in FIG. 2 only for comparison purposes here, it is clearly visible that alfin-layer 4 is interspersed with graphite lamellae, which weaken the alfin-bond because they act as interference spots.

What is claimed is:

1. A process for producing an intermetallic bond between an engine component made from an aluminum alloy having a first alloy composition and a reinforcing component made from austenitic cast iron, said components being bonded to each other by casting technology, comprising the following process steps:

(a) Annealing the reinforcing component in a furnace atmosphere with oxidizing and reducing gas components to at least partly decompose graphite lamellae or graphite particles disposed within the area of the surface of the reinforcing components;

(b) Immersing the reinforcing component in a melt bath consisting of an aluminum alloy having an alloy composition different from the first alloy composition to form an intermetallic bonding layer; and (c) Removing the reinforcing component from the immersion bath, placing the reinforcing component in a casting mold, and directly thereafter pouring the aluminum alloy having the first alloy composition around the reinforcing component.

2. A light metal piston with a reinforcing component made from austenitic cast iron having an intermetallic bonding layer produced between the piston and the reinforcing component by the process specified in claim 1, said intermetallic bonding layer being substantially free of graphite lamellae or graphite particles.

3. The light metal piston according to claim 2, characterized in that the reinforcing component is a ring carrier.

* * * * *